US006176019B1

(12) United States Patent
Frear, Jr.

(10) Patent No.: US 6,176,019 B1
(45) Date of Patent: Jan. 23, 2001

(54) COLLIMATOR MOUNTING APPARATUS FOR BORE SIGHTING A FIREARM

(76) Inventor: Walter F. Frear, Jr., 20016 Frederick Rd., Germantown, MD (US) 20876

( * ) Notice: Under 35 U.S.C. 154(b), the term of this patent shall be extended for 0 days.

(21) Appl. No.: 09/121,723

(22) Filed: Jul. 24, 1998

(51) Int. Cl.[7] ..... F41G 3/00
(52) U.S. Cl. ..... 33/234
(58) Field of Search ..... 33/234, 233; 42/103

(56) References Cited

U.S. PATENT DOCUMENTS

| | | | | |
|---|---|---|---|---|
| 2,367,288 | * | 1/1945 | Klopp et al. | 33/234 |
| 3,711,204 | * | 1/1973 | Steck, III | 356/153 |
| 3,744,133 | * | 7/1973 | Fukushima et al. | 33/234 |
| 4,090,305 | * | 5/1978 | Cassidy | 33/234 |
| 4,534,116 | * | 8/1985 | Davis | 33/234 |
| 4,825,258 | * | 4/1989 | Whitson | 365/153 |
| 5,044,748 | * | 9/1991 | Scott et al. | 356/251 |
| 5,150,527 | * | 9/1992 | Knoster | 33/234 |
| 5,222,302 | | 6/1993 | DeBatty et al. | 33/233 |
| 5,396,708 | * | 3/1995 | Whitley | 33/234 |
| 5,486,913 | * | 1/1996 | Aharon | 356/153 |

FOREIGN PATENT DOCUMENTS 2194621 3/1988 (GB) .

* cited by examiner

*Primary Examiner*—Charles T. Jordan
*Assistant Examiner*—Denise J Buckley
(74) *Attorney, Agent, or Firm*—Donald A. Kettlestrings

(57) ABSTRACT

Apparatus for use with a bore spud for mounting and positioning a collimator with respect to a sighting device or scope on a firearm for bore sighting the firearm provides for adjustment of the collimator to an unlimited number of linear positions from below the center of the bore spud to positions above the bore spud. Greater bore sighting accuracy and more accurate adjustment of the sighting device or scope of the firearm is attained by enabling the collimator to be elevated and held at a precise location which matches that of the elevation of the sighting device or scope from the center of the firearm bore. The apparatus also enables angular adjustment of the collimator to an unlimited number of positions to permit alignment of the collimator with the firearm sighting device when the sighting device is offset and positioned at a location which is angularly displaced from a location directly above the bore of the firearm. The apparatus also enables adjustment of the position of the collimator so the grid screen of the collimator can be aligned vertically and horizontally with the reticle of the offset firearm sighting device.

11 Claims, 9 Drawing Sheets

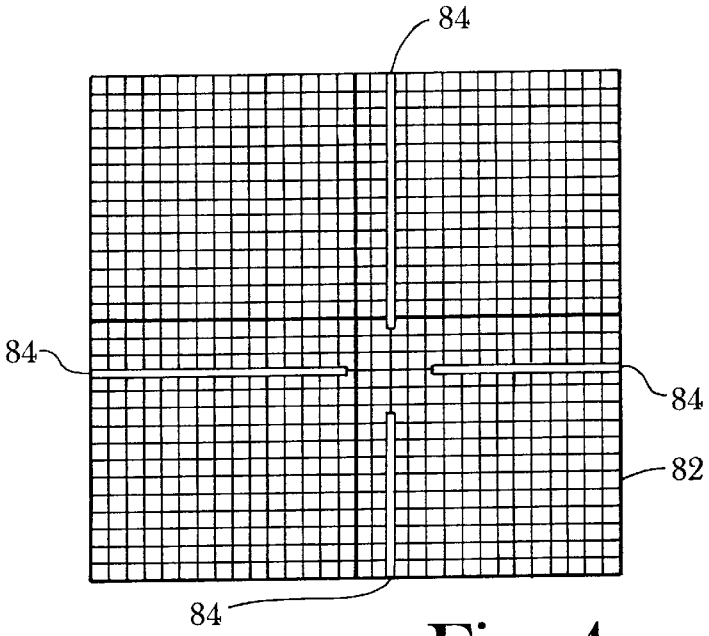
Fig. 4
Fig. 5
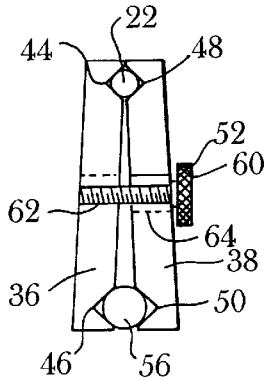
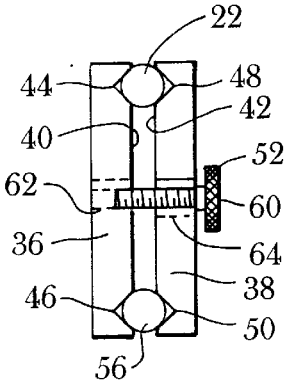
Fig. 6
Fig. 10
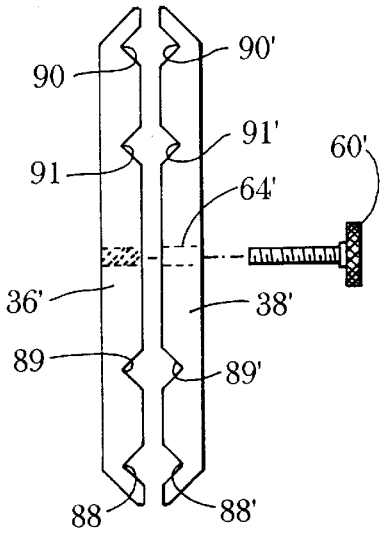
Fig. 9
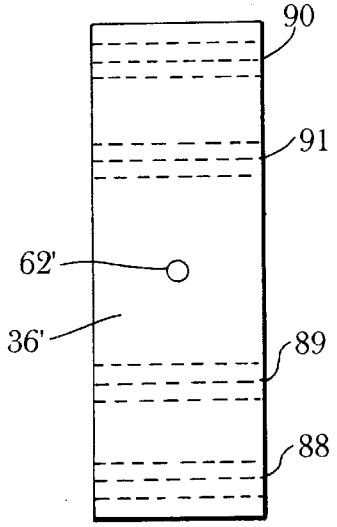

Fig. 8
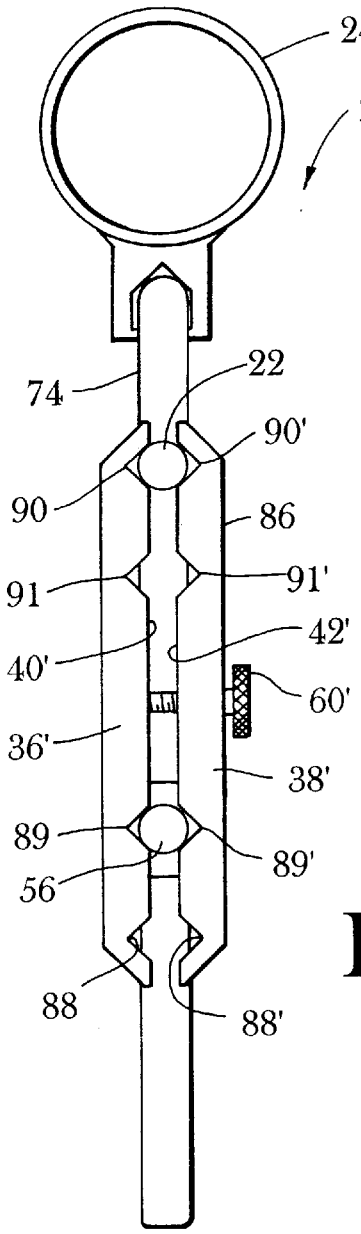
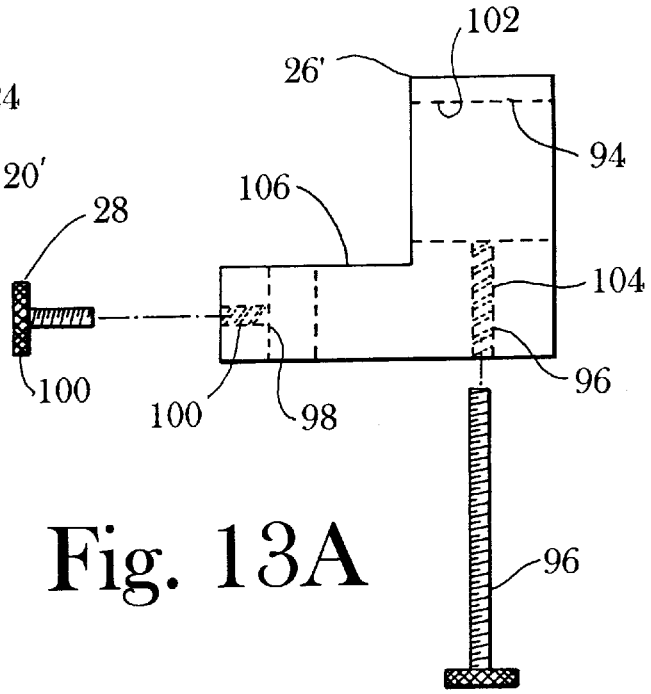
Fig. 13A
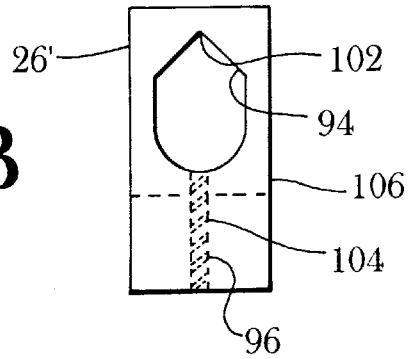
Fig. 13B
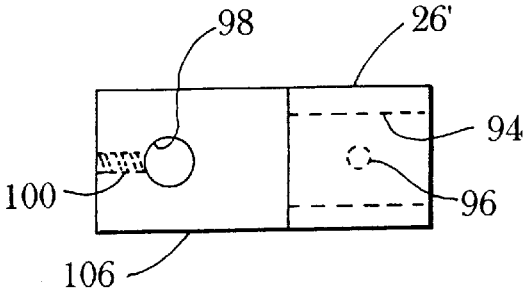
Fig. 13C

Fig. 15A
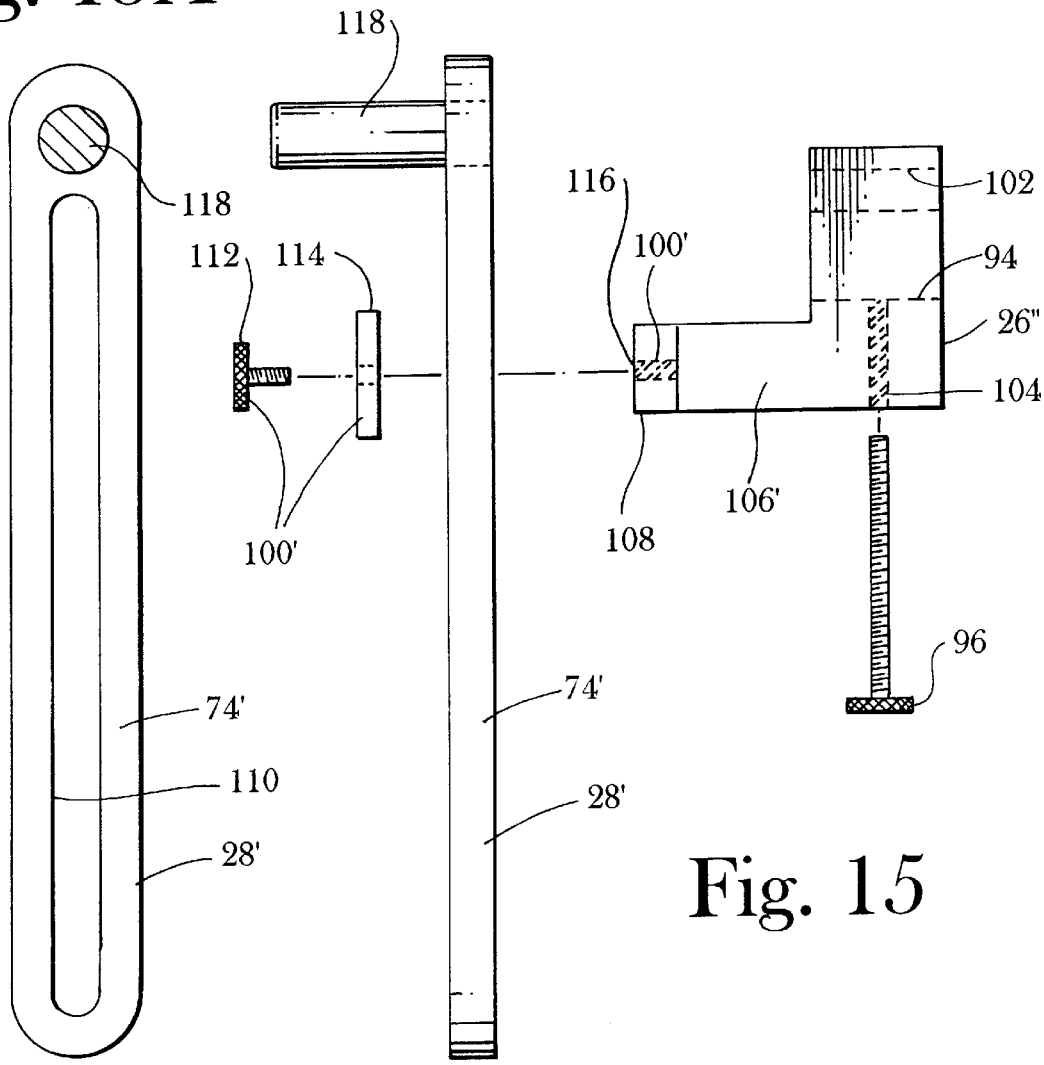
Fig. 15
Fig. 15B
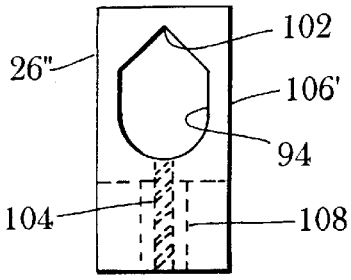
Fig. 15C
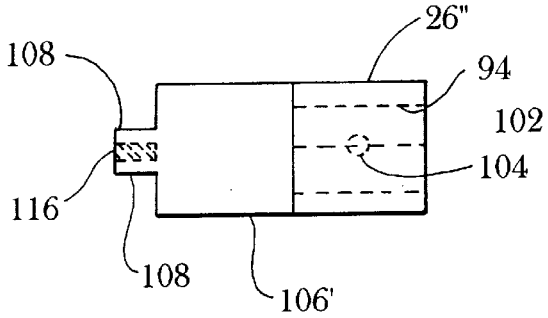

COLLIMATOR MOUNTING APPARATUS FOR BORE SIGHTING A FIREARM

BACKGROUND OF THE INVENTION

This invention relates to apparatus for use with a conventional bore spud for mounting and positioning a conventional collimator with respect to a sighting device or scope on a firearm for bore sighting the firearm and more particularly to such apparatus which provides for adjustably positioning the collimator to an unlimited number of linear and angular positions with respect to the bore spud for enabling the collimator to be precisely aligned with the sighting device or scope.

A scope is an optical sighting device which is mounted on a rifle, shotgun or handgun. All scopes serve to enhance the shooter's ability to acquire a given target. Some scopes do this by magnification, which provides great accuracy at long distances. Others have little or no magnification but rather provide faster acquisition of a given target. All scopes must have a reticle or point of aim, the means by which to adjust the point of aim, a casing in which to house the reticle, and the means or ability with which to mount the scope onto a firearm.

A reticle, which is a center point in a scope, often appear as a cross hair, or in some scopes as a colored dot, often red. The cross hair or dot is placed on the intended target by the shooter looking through, from the rear of the scope. When a scope is first installed onto a firearm, be it a rifle, pistol or shotgun, the scope must first be "sighted in" before it will serve to accurately aim the firearm. A scope is typically "sighted in", by way of mechanical adjustments, for elevation and windage. The process of sighting in can be performed at a target range by shooting at a target and adjusting the scope's reticle to the point of impact. However, this process can be both time consuming and costly to the shooter.

In order to expedite this "sighting in" process, others have developed a means and a device to accurately adjust a scope with respect to the barrel of the firearm onto which the scope is mounted. This process is commonly referred to as "bore sighting", and the device, developed by others, by which this is accomplished is commonly referred to as a collimator.

A collimator is attached to the front of the firearm by way of a "bore spud". A bore spud is a rod of metal approximately three and one-half inches in length which either fits the inner diameter of the firearm's barrel or mechanically expands to match the barrel's inner diameter. The bore spud is placed inside the muzzle of the firearm with approximately one inch protruding. The collimator is then fastened onto the bore spud, placing it directly above the bore of the firearm.

A collimator has an opening on one end which faces the rear of the firearm. Inside the collimator is a very small grid screen with cross hair lines running both vertically and horizontally through the center. With the collimator installed, the shooter sights through the scope and into the collimator. The shooter can now make windage and elevation adjustments to the scope and align the cross hair or dot of the scope with that of the collimator's cross hair. This process, when performed correctly, can be very close to the firearm's "true" point of impact on a real target at roughly one hundred yards.

When a firearm is brought to a gun shop for service it may already be equipped with a scope or optical sighting device. In order to properly service the firearm, the scope is removed.

Before removing the scope, the technician will note where the scope's reticle is adjusted in relation to the firearm's bore. This is done by first installing a collimator. The technician then sights through the scope and into the collimator, viewing the point at which the scope's reticle vertically and horizontally intersects on the collimator's grid screen. This enables the technician to write down precisely where the fire-arm's owner has adjusted the scope. The technician can now remove the scope along with the collimator assembly and proceed with the repair. When service to the firearm is complete, the technician installs the scope along with the collimator assembly and adjusts the scope's reticle to the previously noted point on the collimator.

Various types of collimator mounting devices are known. Examples are described in U.S. Pat. No. 5,222,302 and in UK patent application GB2194621A. Although such devices have served the purpose, they have not proved entirely satisfactory because they allow for only a limited number of discrete positions for the collimator with respect to the firearm sighting device or scope. These devices often allow for positioning of the collimator only at a too low or too high location for proper alignment with the firearm scope, and in some situations the collimator cannot be properly viewed through the scope for accurately bore sighting the firearm. Some collimator mounting devices will partially obstruct the view of the collimator through the scope, thus compromising the accuracy of alignment of the collimator with the scope. Some collimator mounting devices also do not permit for angular positioning of the collimator with respect to the firearm bore to permit proper alignment of the collimator with the firearm scope when the scope is offset and not positioned directly above the firearm bore.

It is, therefore, an object of the present invention to provide apparatus for use with a bore spud for mounting and positioning a collimator with respect to a sighting device or scope on a firearm for bore sighting the firearm.

Another object is to provide such apparatus which enables the collimator to be adjusted to an unlimited number of linear and angular positions with respect to the firearm bore.

A further object of the invention is the provision of such apparatus which will enable precise alignment of a collimator with a firearm sighting device or scope during the bore sighting process.

A further object of the invention is the provision of such apparatus which allows positioning of a collimator above or below the center of the firearm bore.

Another object of the invention is to provide such apparatus which enables positioning of a collimator at an angularly displaced location to the left or to the right of the center line of the firearm bore to position the collimator in precise alignment with an offset firearm sighting device or scope.

Yet another object of the present invention is the provision of such apparatus which enables positioning of a collimator at an angularly displaced location to the left or to the right of the center line of the firearm bore while maintaining the grid screen of the collimator in vertical and horizontal alignment with the reticle of the offset firearm scope or sighting device.

A still further object is to provide such apparatus which can be used with bore spuds of various sizes and diameters.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides apparatus for use with a bore spud for mounting and positioning a collimator with respect to a sighting device or scope on a firearm for bore sighting the firearm, the apparatus comprising: first means for adjustably connecting to the bore spud; and second means for adjustably connecting to the first means and for adjustably supporting the collimator, the second means adjustable to an unlimited number of linear and angular positions with respect to the first means and with respect to the bore spud for enabling the collimator to be precisely aligned with the sighting device or scope.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate preferred embodiments of the invention and, together with the description, serve to explain the principles of the invention.

FIG. 4 is a view showing what a user will see when looking through a sighting device or scope and a collimator;

FIG. 5 is an end elevation view showing the plate members of the embodiment illustrated in FIG. 1 holding a bore spud 22 of a smaller diameter than port element 56;

FIG. 6 is an end elevation view as in FIG. 5 but showing the plate members holding a bore spud 22 of equal diameter to that of port element 56;

FIG. 8 is a front end elevation view of the embodiment shown in FIG. 7;

FIG. 9 is an exploded end elevation view showing the plate members of the embodiment illustrated in FIG. 7;

FIG. 10 is a side elevation view of plate element 36' shown in FIG. 9;

FIG. 13A is an exploded side elevation view of block 106 in the embodiment illustrated in FIG. 11;

FIG. 13B is an end elevation view of block 106;

FIG. 13C is a top plan view of block 106;

FIG. 15 is an exploded side elevation view of block 106' and arm 74' in the embodiment shown in FIG. 14;

FIG. 15A is an elevation view of arm 74' in the embodiment shown in FIG. 14;

FIG. 15B is an elevation view of block 106'; and

FIG. 15C is a top plan view of block 106'.

DESCRIPTION OF THE PREFERRED EMBODIMENTS

Figure 1:
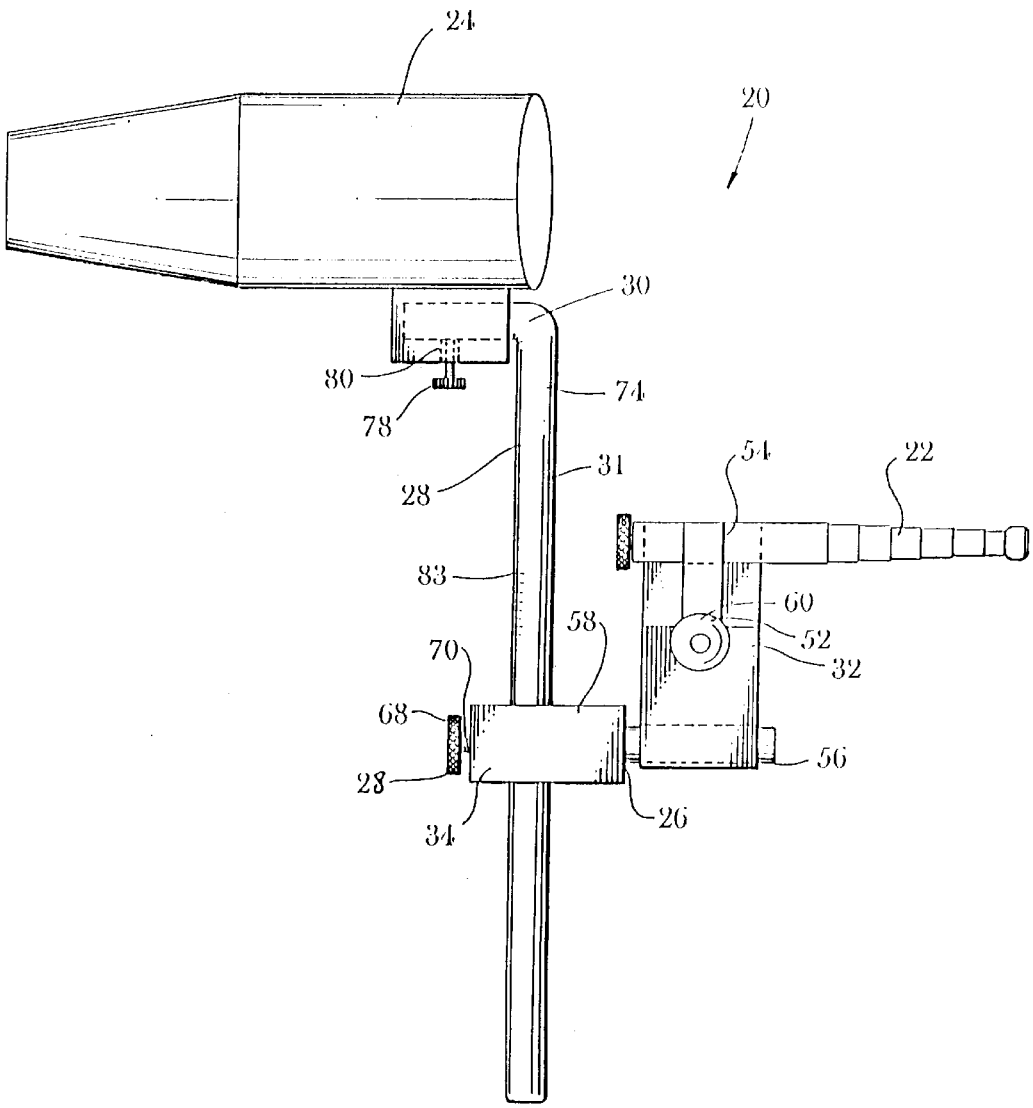
FIG. 1 is a side elevation view showing a first invention embodiment.
Figure 2:
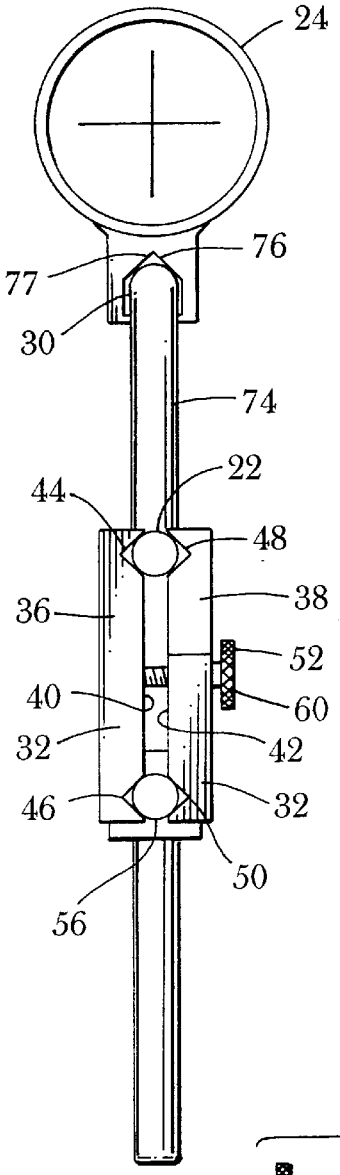
FIG. 2 is a front elevation view of the embodiment shown in FIG. 1.
Figure 3A:
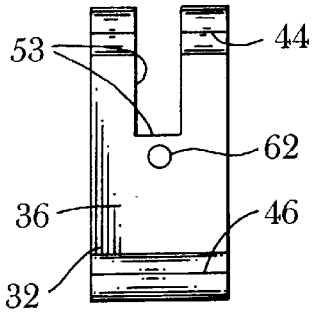
FIGS. 3A and 3B are side elevation views showing plate members of the embodiment shown in FIG. 1.
Figure 3B:
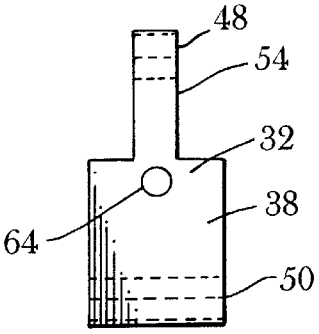
Figure 3C:
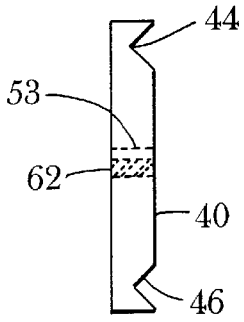
FIGS. 3C and 3D are end elevation views of the plate members shown in FIGS. 3A and 3B.
Figure 3D:
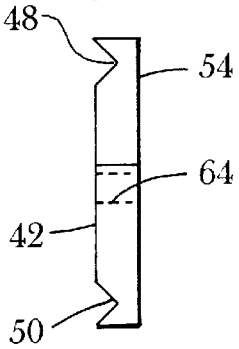
Figure 3E:
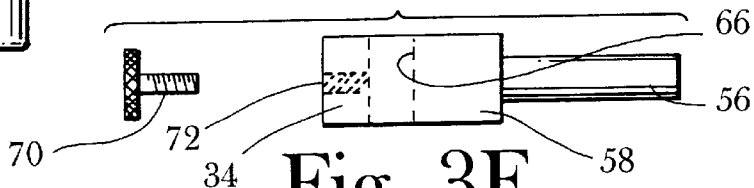
FIGS. 3E and 3F are side elevation and top plan views, respectively, showing the clamp member of the embodiment illustrated in FIG. 1.
Figure 3F:
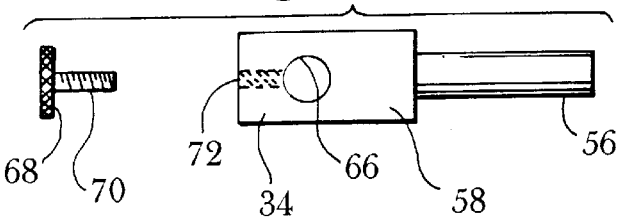
Figure 7:
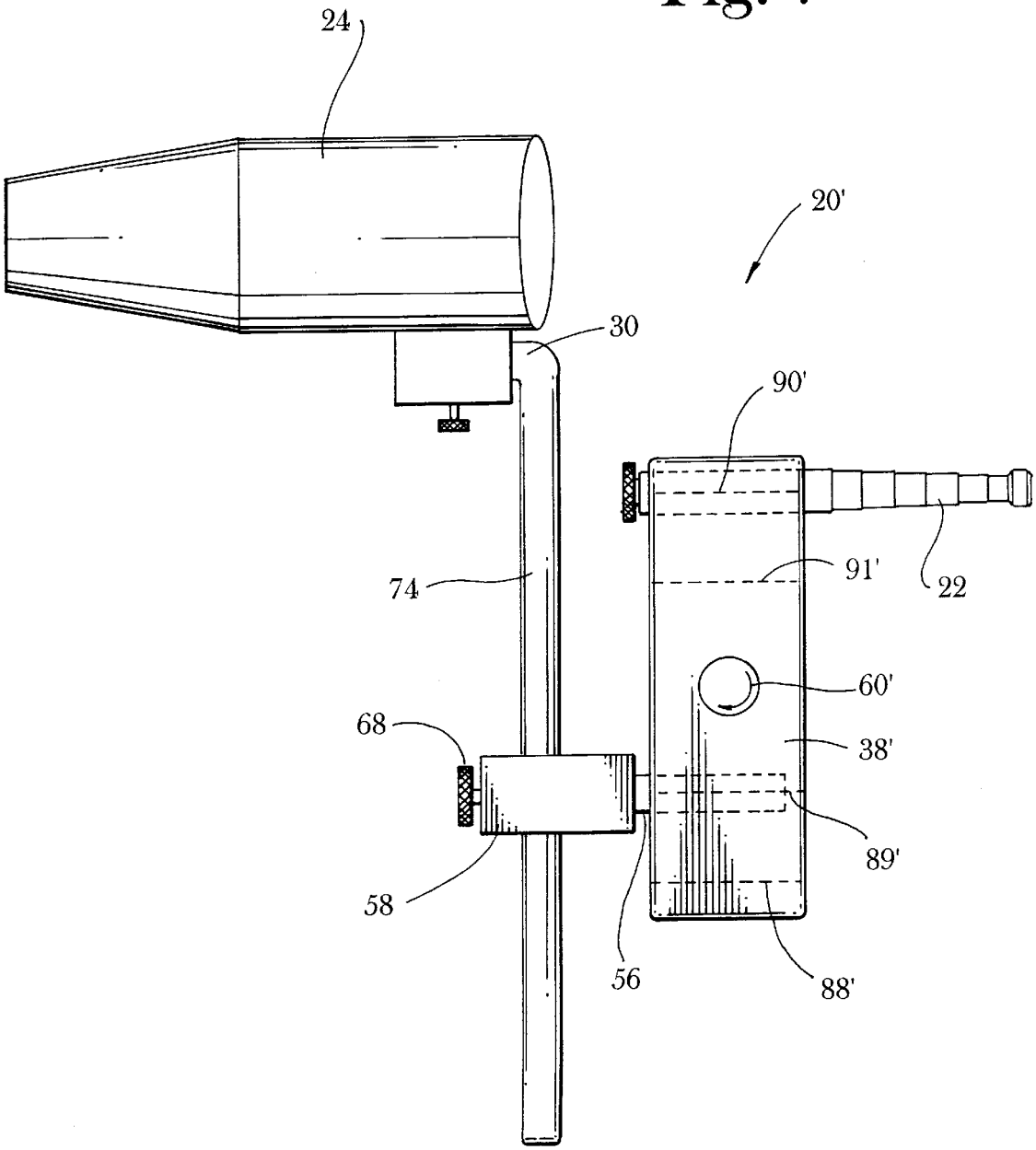
FIG. 7 is a side elevation view showing a second invention embodiment.

With reference now to the drawings, wherein like reference characters designate like or corresponding parts throughout the several views, there is shown in FIGS. 1–6 a preferred embodiment 20 of the invention for use with a conventional bore spud 22 for mounting and positioning a conventional collimator 24 with respect to a sighting device or scope (not shown) on a firearm (not shown) for bore sighting the firearm. Apparatus 20 comprises first means 26 for adjustably connecting to bore spud 22. Apparatus 20 further comprises second means 28 for adjustably connecting to first means 26 and for adjustably supporting collimator 24, second means 28 being adjustable to an unlimited number of linear positions with respect to first means 26 and with respect to bore spud 22 for enabling collimator 24 to be precisely aligned with the sighting device or scope (not shown).

First means 26 is rotatably connected with respect to bore spud 22 for enabling angular adjustment of first means 26 about bore spud 22, and collimator 24 is rotatably connected to a predetermined portion 30 of second means 28 for enabling angular adjustment of collimator 24 about predetermined portion 30.

First means 26 in apparatus embodiment 20 include a first support 32 adjustably connected to bore spud 22 and a second support 34 adjustably connected to first support 32. Second means 28 is adjustably connected to second support 34 for adjustably supporting collimator 24 in an unlimited number of linear positions with respect to second support 34 and with respect to bore spud 22.

First support 32 includes first and second plate members 36, 38. Plate members 36, 38 define surfaces 40, 42, respectively. Surface 40 defines notches 44, 46, and surface 42 defines notches 48, 50 therein.

First support 32 further includes means 52 in operative relationship with plate members 36, 38 for adjustably connecting the plate members together with surfaces 40, 42 in opposed relationship with each other and with notches 44, 48 and 46, 50 in opposed relationship with each other, respectively. Notches 44, 48 preferably receive and hold bore spud 22 therebetween when plate members 36, 38 are connected together by connecting means 52.

Surface 40 defines a centrally positioned gap 53 therein and surface 42 defines a centrally positioned projecting portion 54 in opposed relationship with respect to gap 53 when plate members 36, 38 are connected together by connecting means 52 with surfaces 40, 42 in opposed relationship with each other. As a result of this configuration, projecting portion 54 can extend into gap 53 in interlaced relationship therewith when the diameter of bore spud 22 is smaller than the diameter of post element 56. See FIG. 5.

Second support 34 includes a clamp member 58 having post element 56 connected thereto, and post element 56 is preferably positioned and held between notches 46, 50 of plate members 36, 38 when the plate members are connected together by connecting means 52. Second means 28 is adjustably connected to clamp 58 for adjustably supporting collimator 24 in an unlimited number of linear positions with respect to clamp member 58 and with respect to bore spud 22.

Notch or notches 44 in plate member 36 are positioned in contiguous relationship with and on opposite sides of gap 53, and notch 48 in plate member 38 is positioned within projecting portion 54. Notches 44, 48 are positioned for receiving and holding bore spud 22 therebetween when plate members 36, 38 are connected together by connecting means 52 in opposed relationship with respect to each other. See FIG. 6.

Connecting means 52 include threaded fastener 60 and circular openings 62, 64 within plate members 36, 38, respectively. Opening 64 is larger in diameter than opening 62, and opening 62 is threaded to threadably receive threaded fastener 60.

Clamp member 58 defines circular opening 66 therein, and fastening means 68 includes a threaded post 70 which threadably engages and is adjustable within threaded opening 72 within clamp 58.

Second means 28 includes an elongated cylindrical arm 74 which is L-shaped to define predetermined portion 30 extending orthogonally from primary portion 31 of arm 74. Primary portion 31 of arm 74 is slideably positioned within opening 66, and fastening means 68 fasten arm 74 in any one of an unlimited number of linear positions within opening 66 by engaging arm 74 through threaded opening 72.

In operation and use of apparatus embodiment 20, collimator 24 is fastened onto portion 30 of arm 74 by positioning portion 30 through opening 76 in collimator 24 and by fastening collimator 24 in position by threaded fastener 78. Fastener 78 threadably engages opening 80 in collimator 24 to contact portion 30 of arm 74. Opening 76 preferably defines a ninety degree vertex 77 at the top of opening 76 and fastener 78 secures portion 30 against vertex 77.

Plate members 36, 38 are connected together by fastener 60 with bore spud 22 positioned between notches 44, 48 and with post element 56 positioned between notches 46, 50. Arm 74 is positioned within opening 66 of clamp member 58, and bore spud 22 is inserted into the bore of the firearm (not shown).

Collimator 24 can be adjusted in position to be precisely aligned with the sighting device or scope (not shown) of the firearm (not shown). This can be done by taking a measurement from the side/center of the bore or chamber of the firearm to the side/center of the sighting device or scope which is mounted on the firearm. This measurement is then used to adjust the distance between the center of bore spud 22 and the center of collimator 24. This positioning of collimator 24 with respect to bore spud 22 is accomplished by adjusting the position of arm 74 within clamp 58. Indicia or markings of distance 83 along the length of arm 74 can be used for adjusting the position of arm 74 within clamp 58 to provide for the proper positioning of collimator 24 with respect to the scope. When the desired position of arm 74 and collimator 24 has been obtained, fastener 68 is tightened within threaded opening 72 to secure arm 74 in fixed position within clamp 58.

If the firearm sighting device or scope is offset and is not positioned directly above the firearm bore, the angular position of collimator 24 can be adjusted to allow precise alignment of the collimator with the offset scope. This can be accomplished by rotating post element 56 within notches 46, 50 and by tightening fastener 60 to hold plate members 36, 38 together when the desired angular position of collimator 24 with respect to the scope has been achieved. This can also be accomplished by rotating notches 44, 48 about bore spud 22 and by tightening fastener 60 to hold plate members 36, 38 together when the desired angular position of collimator 24 with respect to the scope has been achieved.

It is also important to position collimator 24 with respect to the firearm sighting device or scope so that the grid screen 82 of collimator 24 is maintained in vertical and horizontal alignment with reticle 84 of the offset firearm scope or sighting device. See FIG. 4. This orientation of collimator 24 is accomplished by rotating opening 76 of collimator 24 about portion 30 of arm 74 and by fastening collimator 24 in a desired fixed position on portion 30 by tightening fastener 78 through opening 80 against portion 30.

With collimator 24 in precise alignment with the sighting device or scope of the firearm, the technician or operator sights through the scope and into the collimator. He can now make windage and elevation adjustments to the scope and align reticle 84 of the scope with the appropriate position in relationship to collimator grid screen 82. See FIG. 4.

The configuration of plate members 36, 38 enables the plate members to firmly grasp and hold a relatively small diameter bore spud 22 within notches 44, 48 while holding a larger diameter post element 56 within notches 46, 50. See FIG. 5. This is accomplished because of the interlacing design of plate members 36, 38 whereby projecting portion 54 can fit into gap 53 in interlaced relationship. This interlaced and angled relationship of plate members 36, 38 with respect to each other is further provided for by opening 64 in plate member 38 having a diameter larger than the diameter of the threaded portion of threaded fastener 60 and by providing for threaded portion of fastener 60 to threadably engage opening 62 in plate member 36. This permits the angled and interlaced connection of plates 36, 38 together by threaded fastener 68, as shown in FIG. 5. As a result of this configuration of plate members 36, 38, apparatus 20 can be used with all conventional bore spuds 22 having diameters smaller or larger than the diameter of post element 56. If the diameter of bore spud 22 is greater than the diameter of post element 56, plate members 36, 38 can still be tightly fastened together in angled relationship with each other. The diameter of larger bore spud 22 and of post element 56 are such that plate surfaces 40, 42 do not contact or interfere with each other when bore spud 22 has a diameter greater than post element 56. See FIG. 6.

Another invention embodiment 20' is shown in FIGS. 7–10. Apparatus 20' is identical to apparatus embodiment 20 with the exception that plate members 36', 38' and threaded fastener 60' are a known B-Square universal spud bracket 86.

The traditional role of B-Square universal spud bracket 86, formed by plate members 36', 38' and threaded fastener 60', is to hold a collimator in one of three fixed positions over the barrel of a firearm for bore sighting the firearm. B-Square bracket 86 is traditionally utilized by placing a conventional bore spud between one of two lower clamping notches 88, 88' or 89, 89' of plate members 36', 38' and by positioning a two inch long rod (not shown) between notches 90, 90' or 91, 91' of plate members 36', 38'. The rod and bore spud are held in place by tightening fastener 60' which brings plate members 36', 38' together. The collimator is then installed onto the rod (not shown) which is positioned and held between notches 90, 90' or 91, 91'. That assembly is then installed onto the muzzle of a firearm (not shown) by placing the bore spud into the barrel of the firearm.

B-Square bracket 86 is used in invention embodiment 20' with clamp member 58 and with arm 74 to enable adjustment of collimator 24 to an unlimited number of linear and angular positions with respect to a bore spud so that the collimator can be precisely aligned with the firearm sighting device or scope.

Bore spud 22 is positioned and held between notches 90, 90' or 91, 91' and post element 56 of clamp 58 is positioned and held between notches 89, 89' or 88, 88' of plate members 36', 38'. Positioning of collimator 24 in precise alignment with the sighting device or scope (not shown) of the firearm (not shown) is accomplished in the same manner as described with respect to apparatus embodiment 20. However, because of the configuration of B-Square universal spud bracket 86, it may be difficult or impossible to use apparatus 20' when bore spud 22 is significantly smaller in diameter than the diameter of post element 56. The smaller diameter bore spud cannot be firmly grasped and held between notches 90, 90' or 91, 91' when a larger diameter post element 56 is positioned within notches 89, 89' or 88, 88'. This is because surfaces 40', 42' of plate members 36', 38' will contact each other before the relatively small diameter bore spud 22 can be tightly gripped between notches 90, 90' or 91, 91' when threaded fastener 60' is tightened to hold plate members 36', 38' together. This problem can be avoided by use of plate members 36, 38 of invention embodiment 20.

Figure 11:
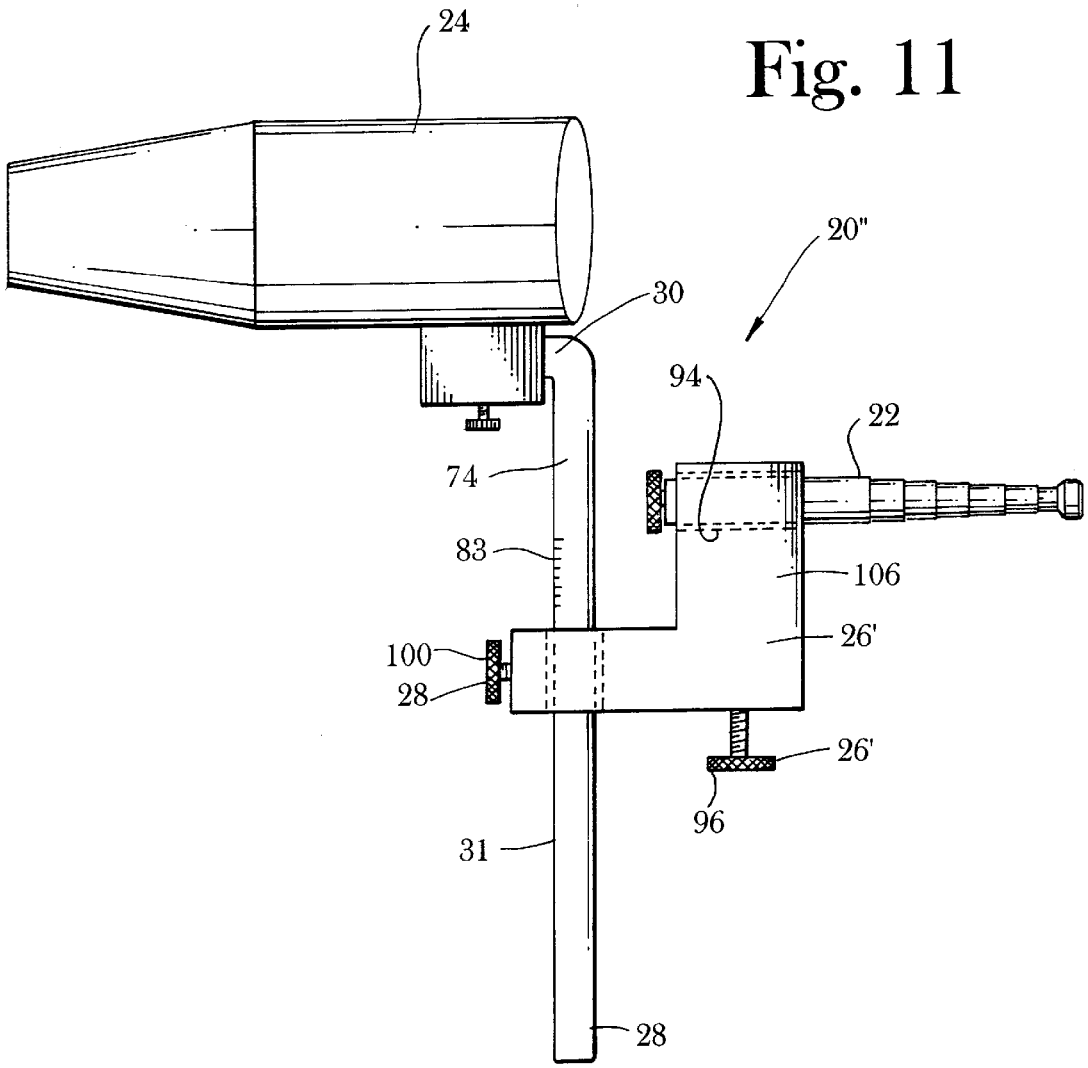
FIG. 11 is a side elevation view showing a third invention embodiment.
Figure 12:
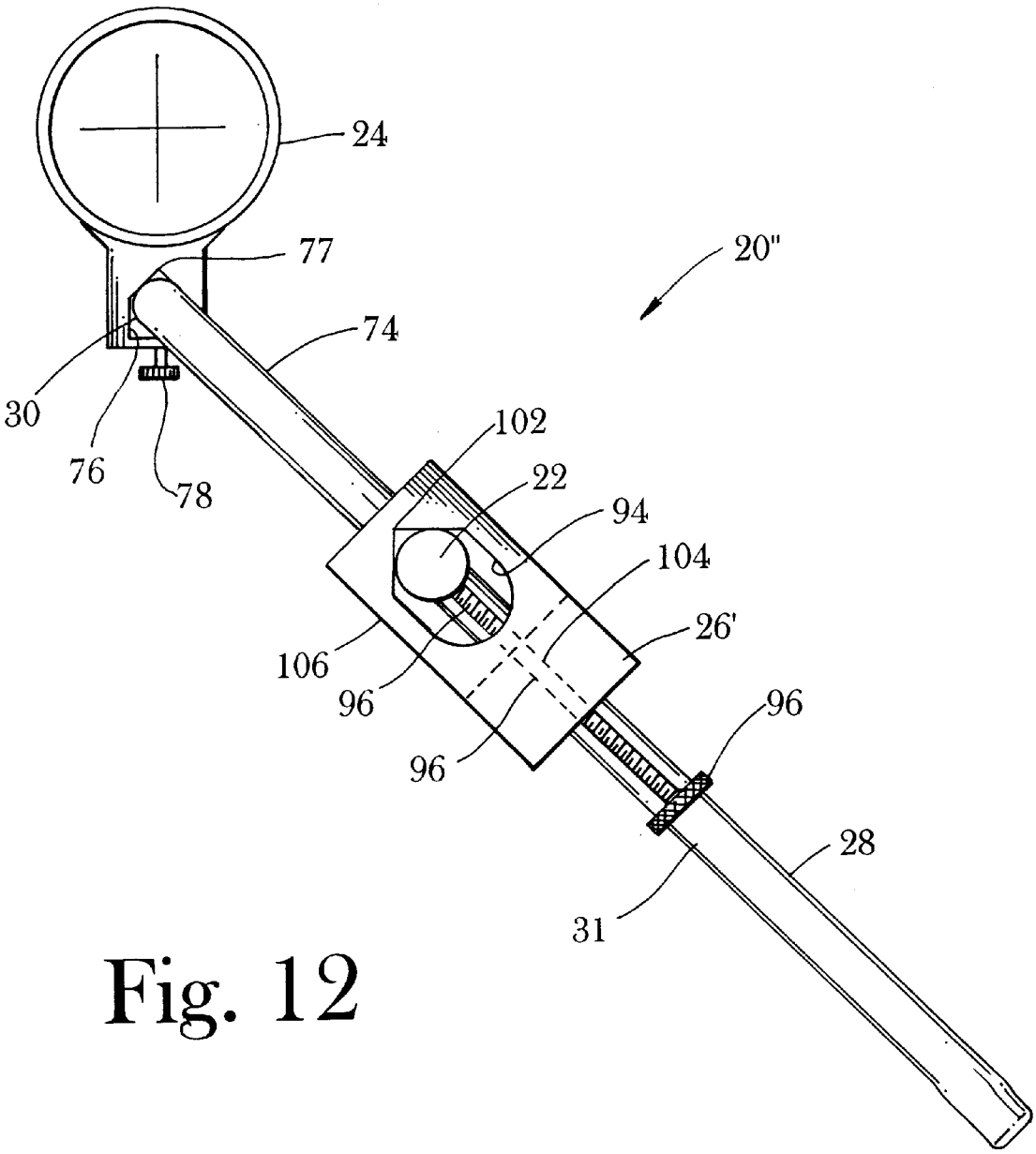
FIG. 12 is a front end elevation view of the embodiment shown in FIG. 11.

Another invention embodiment 20" is shown in FIGS. 11–13.

Apparatus 20" includes first means 26' which defines a bore spud receiving opening 94 therein. Opening 94 extends in a first direction, and first means 26' further includes fastening means 96 in operative relationship with opening 94 for fastening bore spud 22 in position within opening 94.

First means 26' further defines a second opening 98 therein extending in a second direction orthogonally positioned with respect to opening 94. Second means 28 are provided for adjustably connecting to first means 26' and for adjustably supporting collimator 24. Second means 28 are adjustable to an unlimited number of linear positions with respect to first means 26' and with respect to bore spud 22 for enabling collimator 24 to be precisely aligned with the sighting device or scope.

Second means 28 include arm 74 and fastening means 100 in operative relationship with opening 98 and with arm 74 for fastening arm 74 in any one of an unlimited number of linear positions within opening 98.

Opening 94 preferably defines an upper portion which defines a ninety degree vertex 102. As previously described, arm 74 is L-shaped and defines a primary elongated portion 31 for positioning through opening 98. Arm 74 also defines a secondary portion 30 extending orthogonally from primary portion 31, and collimator 24 is adjustably connected to secondary portion 31 as previously described.

When a cylindrical bore spud 22 is placed into bore spud opening 94 of apparatus 20", fastener 96, which is positioned beneath and in perpendicular relationship with respect to vertex 102, is rotated to threadably engage and move within threaded opening 104, which also extends perpendicularly with respect to vertex 102. Fastener 96 secures bore spud 22 against vertex 102. See FIG. 12.

Means 26' preferably includes an L-shaped block 106, and block 106 can be angularly adjusted or rotated with respect to bore spud 22 to an unlimited number of positions for enabling collimator 24 to be precisely aligned with an offset sighting device or scope of the firearm. See FIG. 12. Collimator 24 can be rotated and adjusted in position with respect to portion 30 of arm 74 in a manner as previously described so that grid screen 82 of collimator 24 can be maintained in vertical and horizontal alignment with reticle 84 of the offset firearm scope or sighting device. See FIG. 4.

In operation and use of apparatus embodiment 20", a conventional bore spud 22 of the correct size for the firearm is installed within opening 94 and is clamped into fixed position by fastener 96. Collimator 24 is then installed onto portion 30 of arm 74 as previously described. Bore spud 22 is then placed into the muzzle end of the firearm (not shown). A vertical measurement is then made from the side/center of the bore or chamber of the firearm to the side/center of the mounted sighting device or scope. The length of this measurement is then used to determine the distance between the center of bore spud 22 and the center of collimator 24. Adjustment of the position of collimator 24 to be precisely aligned with the scope is accomplished by movement of arm 74 through opening 98 of block 106. Indicia or markings 83 on arm 74 can be used for this purpose. When the proper position of collimator 24 with respect to the scope has been achieved, arm 74 is fixed into position by tightening of fastener 100.

With collimator 24 in precise alignment with the sighting device or scope of the firearm, the technician or operator sights through the scope and into the collimator. He can now make windage and elevation adjustments to the scope and align reticle 84 of the scope with respect to collimator grid screen 82.

Angular adjustment of the position of collimator 24 with respect to bore spud 22 can be accomplished by rotating block 106 about bore spud 22 until collimator 24 is aligned with an offset sighting device or scope of the firearm. Collimator 24 can then be rotated in position about portion 30 of arm 74 so that grid screen 82 of the collimator is in vertical and horizontal alignment with reticle 84 of the scope. See FIG. 4.

Figure 14:
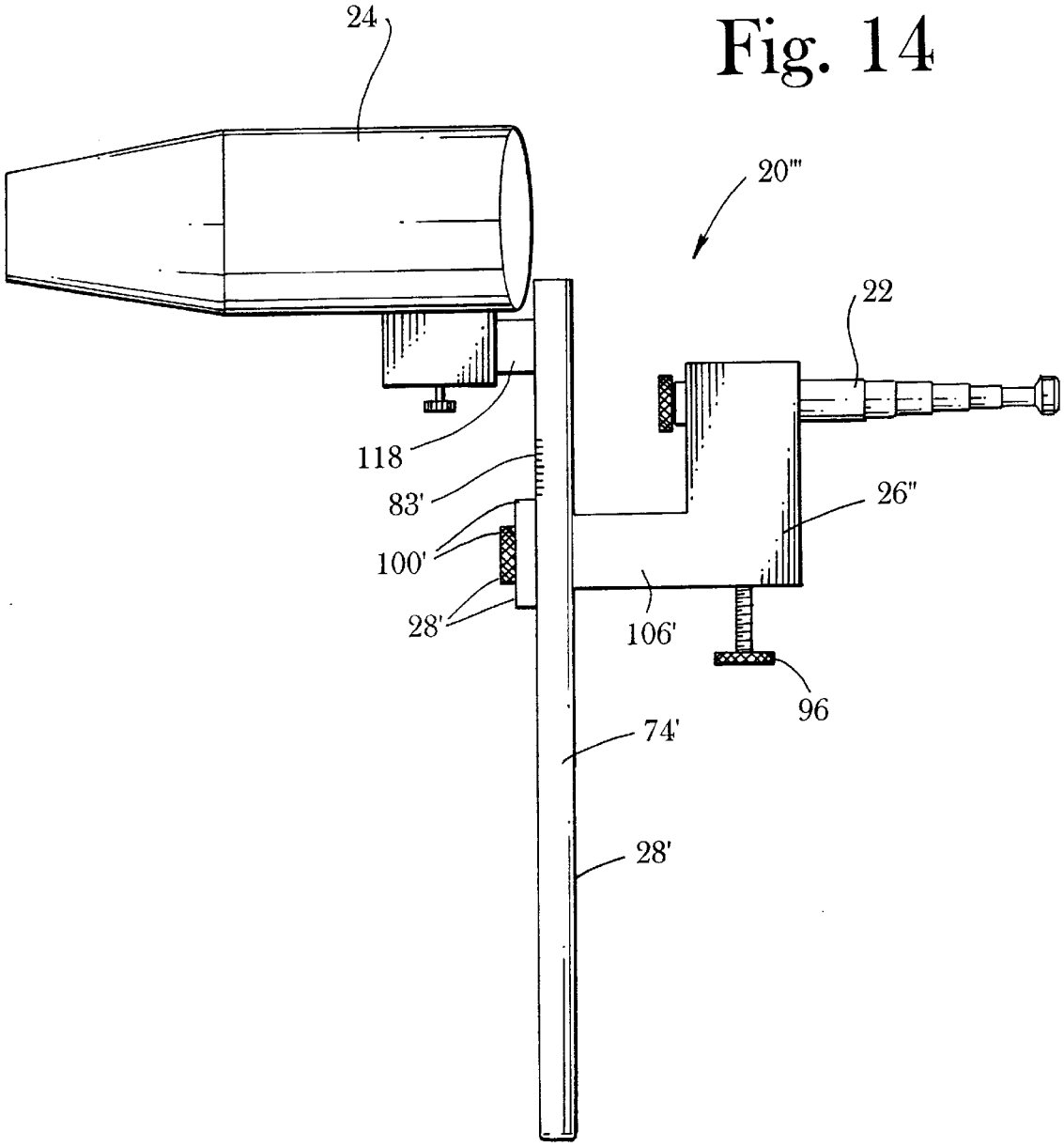
FIG. 14 is a side elevation view of a fourth invention embodiment.

Another invention embodiment 20'" is illustrated in FIGS. 14–15C.

Apparatus 20'" is identical to apparatus embodiment 20" with the exception that first means 26" of embodiment 20'" defines a projection 108 and second means 28' includes an elongated arm 74' defining an elongated opening 110 therein for slideably receiving projection 108 therein. Fastening means 100' are provided in operative relationship with arm 74' and with projection 108 for fastening arm 74' to L-shaped block 106' in any one of an unlimited number of Linear positions.

Fastening means 100' include a threaded fastener 112, a washer 114 and a threaded opening 116 within the end of projection 108. Fastener 112 is positioned through washer 114 and is threaded into opening 116 while fastener 112 extends through opening 110 of arm 74'. Projection 108 extends into opening 110 to prevent lateral or rotational movement of arm 74' with respect to block 106' and to permit only linear adjustment of the position of arm 74' with respect to projection 108 along the length of opening 110.

Arm 74' includes a mounting element or post 118 which projects outwardly at a right angle from arm 74', and collimator 24 is adjustably connected to mounting element 118 in the manner previously described with respect to the connection of collimator 24 to arm portion 30 in embodiments 20–20".

Operation and use of apparatus embodiment 20'" is identical to that of embodiment 20" with the exception that arm

74' is adjusted linearly along the length of opening 110 with projection 108 extending through opening 110.

Angular adjustment of the position of collimator 24 with respect to bore spud 22 can be accomplished by rotating block 106' about bore spud 22 until collimator 24 is aligned with an offset sighting device or scope of the firearm. Collimator 24 can then be rotated in position about mounting element 118, in a manner as previously described with respect to rotation of collimator 24 about portion 30 in embodiments 20–20", so that grid screen 82 of the collimator is in vertical and horizontal alignment with reticle 84 of the scope. See FIG. 4.

This invention provides apparatus for adjusting the position of a collimator to an unlimited number of linear and angular positions with respect to a bore spud during the process of bore sighting a firearm. Greater bore sighting accuracy and more accurate adjustment of the firearm sighting device or scope is attained by enabling the collimator to be precisely aligned with the scope as provided by this invention.

The invention in its broader aspects is not limited to the specific details shown and described, and departures may be made from such details without departing from the principles of the invention and without sacrificing its chief advantages.

What is claimed is:

1. Apparatus for use with a bore spud for mounting and positioning a collimator, said apparatus comprising:

first means for adjustably and fixedly connecting to said bore spud;

second means for adjusteably and fixedly connecting to said first means and for adjustably supporting said collimator, said second means adjustable to an unlimited number of linear positions with respect to said first means and with respect to said bore spud;

said first means being rotatably connected to said bore spud for enabling angular adjustment of said first means about said bore spud to a plurality of fixed positions with respect to said bore spud;

said collimator being rotatably connected to a predetermined portion of said second means and wherein said collimator is angularly adjustable about said predetermined portion to a plurality of fixed positions with respect to said predetermined portion; and wherein said first means defines a first bore spud receiving opening therein extending in a first direction and wherein said first means includes first fastening means in operative relationship with said first opening for fastening said bore spud in position within said first opening.

2. Apparatus as in claim 1 wherein said first means further defines a second opening therein extending in a second direction substantially orthoganally positioned with respect to said first opening, and wherein said second means includes an arm and second fastening means in operative relationship with said second opening and with said arm for fastening said arm in any one of said unlimited positions within said second opening.

3. Apparatus as in claim 2 wherein said arm is substantially L-shaped and defines a primary elongated portion for positioning through said second opening and defines a secondary portion extending orthoganally from said primary portion, said collimator adjustably connected to said secondary portion.

4. Apparatus as in claim 3 wherein said collimator is rotatably connected to said secondary portion for enabling said angular adjustment of said collimator about said secondary portion.

5. Apparatus as in claim 1 wherein said first means defines a projection and wherein said second means includes an elongated arm defining an elongated opening therein for slideably receiving said projection therein, and second fastening means in operative relationship with said arm and with said projection for fastening said arm in any one of said unlimited positions.

6. Apparatus as in claim 5 wherein said arm includes a mounting element projecting outwardly from said arm, said collimator adjustably connected to said mounting element.

7. Apparatus for use with a bore spud for mounting and positioning a collimator, said apparatus comprising:

first means for adjustably and fixedly connecting to said bore spud;

second means for adjustably and fixedly connecting to said first means and for adjustably supporting said collimator, said second means adjustable to an unlimited number of linear positions with respect to said first means and with respect to said bore spud;

said first means being rotatably connected to said bore spud for enabling angular adjustment of said first means about said bore spud to a plurality of fixed positions with respect to said bore spud;

said collimator being rotatably connected to a predetermined portion of said second means and wherein said collimator is angularly adjustable about said predetermined portion to a plurality of fixed positions with respect to said predetermined portion; and said first means including a first support adjustably connected to said bore spud and a second support adjustably connected to said first support, said second means adjustably connected to said second support for adjustably supporting said collimator in said unlimited number of linear positions with respect to said second support and with respect to said bore spud.

8. Apparatus as in claim 7 wherein said first support includes:

first and second plate members, each of said plate members defining a surface having a plurality of notches therein; and means in operative relationship with said plate members for adjustably connecting said plate members together with said surface in opposed relationship with each other and with predetermined of said notches in said plate members in opposed relationship with each other and with two of said notches in said first and second plate members, respectively, receiving and holding said bore spud therebetween.

9. Apparatus as in claim 8 wherein said second support includes a clamp member having a post element, said post element positioned and held between predetermined of said notches in said plate members when said plate members are connected together, said second means adjustably connected to said clamp member for adjustably supporting said collimator in said unlimited number of linear positions with respect to said clamp member and with respect to said bore spud.

10. Apparatus as in claim 9 wherein said first plate member surface defines a substantially centrally positioned gap therein and wherein said second plate member surface defines a substantially centrally positioned projecting portion in opposed relationship with respect to said gap when said first and second plate members are connected together by said connecting means with said plate member surfaces in said opposed relationship with each other, whereby said projecting portion can extend into said gap in interlaced relationship therewith when a diameter of said bore spud is smaller than a diameter of said post element.

11. Apparatus as in claim 10 wherein at least a first one of said notches in said first plate member is positioned in contiguous relationship with said gap and wherein at least a second one of said notches in said second plate member is positioned within said projecting portion, whereby said first and second notches are positioned for receiving and holding said bore spud therebetween when said first and second plate members are connected together in said opposed relationship.

* * * * *